United States Patent [19]

Schott

[11] Patent Number: 4,901,999

[45] Date of Patent: Feb. 20, 1990

[54] HAND, WRIST, AND FOREARM FRICTION RESISTANCE EXERCISE DEVICE

[76] Inventor: Lawrence A. Schott, 15940 Warwick, Detroit, Mich. 48223

[21] Appl. No.: 269,077

[22] Filed: Nov. 9, 1988

[51] Int. Cl.[4] ..... A63B 23/00

[52] U.S. Cl. ..... 272/67; 272/131; 272/132

[58] Field of Search ..... 272/67, 68, 96, 125, 272/131, 132, 140, 143

[56] References Cited

U.S. PATENT DOCUMENTS

| | | | |
|---|---|---|---|
| 3,184,234 | 5/1965 | Struble | 272/131 |
| 3,428,311 | 2/1969 | Mitchell | 272/132 |
| 3,811,672 | 5/1974 | Simmons | 272/67 |
| 4,186,920 | 2/1980 | Fiore et al. | 272/96 |
| 4,379,552 | 4/1983 | Webb et al. | 272/67 |
| 4,664,370 | 5/1987 | Finch | 272/67 |

*Primary Examiner*—Richard J. Apley
*Assistant Examiner*—David H. Willse
*Attorney, Agent, or Firm*—Barnes, Kisselle, Raisch, Choate, Whittemore & Hulbert

[57] ABSTRACT

An exercise device which provides tone and strength to the muscles and opposing muscles of the hand, wrist, and forearm. The device comprises a pair of spherical balls attached to the ends of a cylindrical bar. The spherical balls are pressed between a pair of grip handles which are detachably engaged together. The grip handles are able to rotate about the X, Y and Z axes of the spherical balls in essentially universal motion.

7 Claims, 1 Drawing Sheet

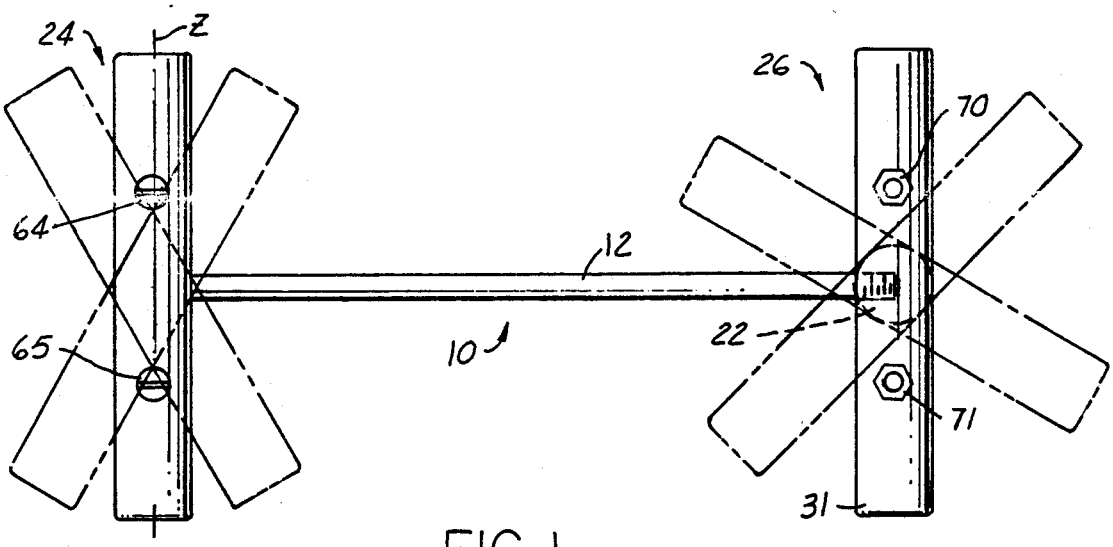
FIG. 1
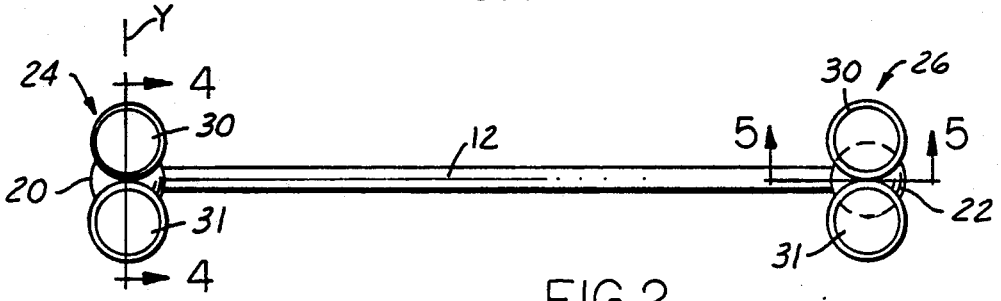
FIG. 2
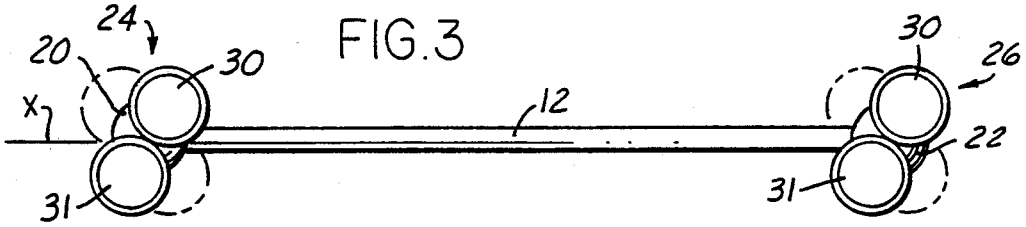
FIG. 3
FIG. 4
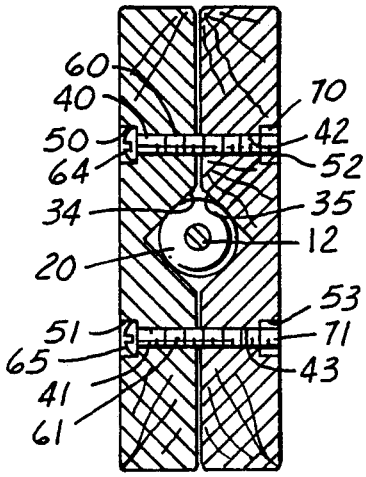
FIG. 5
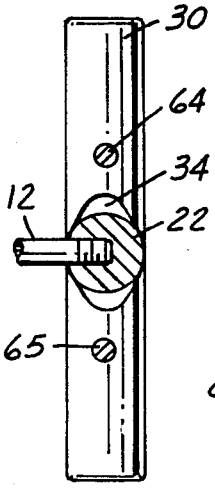
FIG. 6
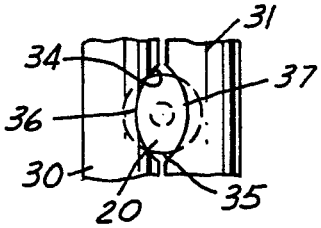
FIG. 7
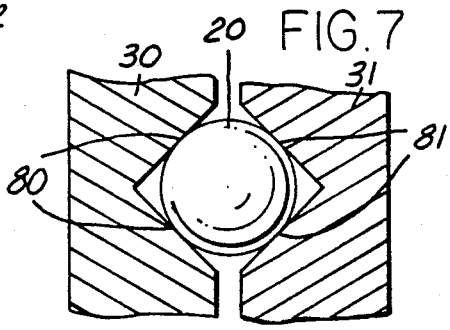

HAND, WRIST, AND FOREARM FRICTION RESISTANCE EXERCISE DEVICE

FIELD OF INVENTION

This invention relates to a muscle developing exercising device and more particularly to a device which uses friction resistance to develop hand, wrist and forearm muscles.

BACKGROUND AND SUMMARY OF INVENTION

There are a variety of exercise devices for the hand, forearm and wrist. Some employ a stationary torque or torsional member for resistance to turning or twisting. Generally the user's hands will grip each end of the exerciser, turning the ends in opposite directions with a force great enough to overcome the rigidity of the torsional member, such as Griffin U.S. Pat. No. 3,708,164 and Nielsen U.S. Pat. No. 3,084,547. Others employ hydraulic fluid as a resistance to twisting. A Rotary resistant torque is developed by restricting the flow of hydraulic fluid from one chamber to another between the hand grips of the exerciser, such as Stoecker U.S. Pat. No. 4,171,802. And others use friction disc as a resistance means. In this invention a pair of grips are rotated relative to each other with enough force to overcome the frictional engagement of disc-like members located between the hand grips, such as Struble U.S. Pat. No. 3,184,234.

Still these disclosures provide only an exercise of turning and rotating the grips about a fixed axis in a single plane. The Mitchell U.S. Pat. No. 3,428,311 disclosed a therapeutic exercising device for rehabilitation of the musculature of the upper extremity. The Mitchell disclosure comprises a base with a concave seat, a solid ball nested in this seat with a cage threaded onto the top of the base and over the solid ball, an upstanding bar mounted on the ball and a hand grip on the opposite end adapted to be grasped for twisting the bar and the attached ball 360° in the cage. To increase resistance the cage can be screwed down onto the base and thus applying pressure to the solid ball and increasing frictional drag. The handle and bar are movable in arcs limited only by the diameter of the opening in the center of the annular seat. Such arcs may be varied 360° relative to the polar axis of the ball. Therefore, it provides more versatility then the standard hand exerciser which only provides rotational resistance. But, the Mitchell invention provides exercise for only one hand at a time. In addition it is not compact and portable, it must be mounted to a bench or wall or clamped to a door opening.

The present invention is directed to a portable hand and wrist exercise unit which can be readily carried in a traveling case. It is especially designed for athletes, such as golfers, who desire to strengthen their hands and wrists, and is useful for persons suffering from arthritis who must continually strive for mobility or in the hand and wrist points. For every muscle in the appendages there is an equal and opposing muscle. This invention provides frictional resistance to both sets of muscles. The unit is especially designed for infinite angle dispositions which allows versatile use adaptable to any particular motion desired. In addition, it facilitates isometric exercise of the arms while hand exercise is progressing.

BRIEF DESCRIPTION OF THE DRAWINGS

Drawings accompanied this disclosure and the various views thereof may be described as follows:

FIG. 1, a plan view of the apparatus of this invention with the various handle positions shown in phantom.

FIG. 2, a side elevational view of the apparatus of this invention.

FIG. 3, a side elevational view of the apparatus of this invention with the various handle positions shown in phantom.

FIG. 4, a sectional view taken along line 4—4 in FIG. 2.

FIG. 5, a fragmentary sectional view taken along line 5—5 in FIG. 2.

FIG. 6, a partial end elevational view of the apparatus of this invention.

FIG. 7, a partial enlarged view of the apparatus of this invention shown in FIG. 4.

DETAILED DESCRIPTION OF PREFERRED EMBODIMENT

With reference to the drawings, a hand exerciser device 10 is shown in its various positions in FIG. 1. The hand exerciser 10 comprises of a solid elongate cylindrical bar 12 which has fixedly attached to it a pair of solid spherical balls 20, 22 by conventional means such as press-fitting, welding, or other fastening means.

A grip handle 24, 26 is mounted over each of the spherical balls 20, 22. The grip handles 24, 26 is made up of a pair of solid cylindrical rods 30, 31, which is preferably made of wood or similar material to insulate from the frictional resistance heat dissipation. All cylindrical rods are identical in construction. Each rod 30, 31 has a concave seat 34, 35 located on the center of its circumferential side. The concave seat 34,35 depth dimension is less than the radius dimension of the spherical ball 20, 22. Also, part of the sides 36,37 of the concave seat 34, 35 along the center circumferential surface of the cylindrical rod 30, 31 are removed to allow the grip and handle 24, 26 to rotate about the Y and Z axes of the spherical ball (see FIG. 1 and FIG. 3). But enough of the side 36, 37 is retained to hold the spherical ball 20, 22 in the concave seat 34, 35. Each rod 30, 31 has a pair of bores 40, 41 and 42, 43 through the circumferential side equally spaced from and parallel to its respective concave seat 34, 35. Countersink bores 50, 51, 52, 53 are placed on respective bores 40, 41, 42, 43 directly opposite the concave seat 34, 35.

The cylindrical rods 30, 31 capture the solid spherical balls 20, 22 in the concave seats 34, 35. In addition the cylindrical rods 30, 31 have bores 40, 41, 42, 43 in proper alignment and the countersinks 50, 51, 52, 53 facing outward. The round head stove bolts 60, 61 are guided into the respective countersink bore 50, 51 through the respective bores 40, 42 and 41, 43 to be received by a hexagon nut 70, 71 seated in the opposite countersink bore 52, 53. Both the bolt head 64, 65 and the nut 70, 71 remain below the circumferential surface of the cylindrical rod 30, 31.

As the bolt 60, 61 is screwed into nut 70, 71, the cylindrical rods 30, 31 press down on the spherical ball 20, creating a frictional resistance to movement between the ball 20,22 and grip handle 24, 26. The frictional resistance can be varied by tightening or loosening the bolt 60, 61 from nut 70, 71.

FIG. 7 shows that the frictional resistance occurs on two annular lines of contact 80, 81 between cylindrical rod 30, 31 and spherical ball 20. The lines of contact 80, 81 are located half way between the equator and both poles of the ball. These lines of contact 80, 81 provide a uniform resistance to the movement of the cylindrical rods 30, 31 about X, Y and Z axes.

In use, the above described exerciser 10 provides tone and strength to the hand, wrist and forearm muscles and their opposing muscles at home, work or in transit. The muscles and opposing muscles are exercised by turning, twisting and moving the grip handles 24, 26 to overcome the frictional resistance along a line of contact between the spherical balls 20, 22 and the concave seats 34, 35 of the cylindrical rods 30, 31.

The grip handles are provided three basic motions, a rotation about the X, Y, and Z axes of the spherical balls 20, 22. It is important to note that the movement of the grip handles 24, 26 is not limited to these three motions and that there exists a number of combinations of these three motions to provide exercise of various muscle groups affected.

The first basic motion is made by grasping the handles 24, 26 and rotating them relative to each other in a plane perpendicular to the cylindrical bar 12 axis (X-axis). The handles 24, 26 can freely rotate 360° about the X-axis of the spherical balls 20, 22. The frictional resistance between the balls 20, 22 and grip handles 24, 26 to this motion provides a flexing and extending exercise to the muscles of the hand, wrist and forearm.

The second basic motion is made by turning or twisting the grip handles 24, 26 about the Y axis of the spherical balls 20, 22 as shown in the phantom positions in FIG. 1. The grip handles 24, 26 is limited to a rotation of approximately 135° about the Y axis of the spherical balls 20, 22 by the cylindrical bar 12. This motion provides exercise for the hand and wrist muscles.

In the third motion, the grip handles 24, 26 rotate about the Z axis of the spherical balls 20, 22 as shown in solid and phantom positions in FIG. 3. The grip handles travel is limited to a rotation of 90° about the Z axis of the spherical balls 20, 22 by the cylindrical bar 12. This motion provides strengthening to the hand and wrist muscles. There is, therefore, essentially a universal motion in all directions limited only by the interference of the handles and the bar in counter directions.

The frictional resistance can be increased when the muscles have strengthened and require a greater challenge, or there is a desire for increased strength within the hand, wrist or forearm. By tightening the bolts 60, 61 into the respective nuts 70, 71, the grip handles 24, 26 are pressed tighter over the spherical balls 20, 22 increasing the frictional drag.

What is claimed:

1. A wrist, grip and forearm exerciser comprising a bar with a ball attached to each end and a tension adjustable hand grip clamped on each ball.

2. An isometric exercise device for the hand, wrist, and forearms which requires equal and opposite forces to move the device from and to initial positions, comprising:

(a) an elongate bar, (b) handles encompassing each end of said bar disposed in position generally transverse of said bar, (c) means on said bar and on each said handle to mount said handles for manual movement about the ends of said bar for essentially universal motion, and (d) said means including an adjustable torque control to provide resistance to said manual movement to require muscular effort to achieve said movement.

3. An isometric exercise device as defined in claim 2 wherein said means comprises spherical balls affixed to the ends, recesses on said handles to capture each ball respectively, and tension units to control portions of said handles around said balls to increase or decrease the resistance to manual movement.

4. In a muscle developing exerciser, (a) a solid elongate bar, (b) a solid spherical balls fixedly fit onto the ends of said cylindrical bar, (c) handle means mounted so as to capture each said spherical ball, and (d) means to hold said handle means together around said ball, whereby each said handle means frictionally acts on a line of contact on said spherical ball causing frictional resistance to movement of said handle means about the X, Y, and Z axes of each said spherical ball and movement relative to other said handle means.

5. A muscle developing exerciser as defined in claim 4 in which said handle means comprises two parts each having a concave seat for said spherical ball.

6. A muscle developing exerciser as defined in claim 4 in which said means comprises a plurality of screws whereby frictional resistance can be increased or decreased.

7. A muscle developing exerciser as defined in claim 4 in which said line of contact is located approximately half way between the pole and the meridian of said spherical ball.

* * * * *